US008228342B2

(12) United States Patent
Koyama

(10) Patent No.: US 8,228,342 B2
(45) Date of Patent: Jul. 24, 2012

(54) IMAGE DISPLAY DEVICE, HIGHLIGHTING METHOD

(75) Inventor: Fumio Koyama, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 544 days.

(21) Appl. No.: 12/371,746

(22) Filed: Feb. 16, 2009

(65) Prior Publication Data

US 2009/0207188 A1 Aug. 20, 2009

(30) Foreign Application Priority Data

Feb. 18, 2008 (JP) ..... 2008-036450

(51) Int. Cl.
*G09G 5/00* (2006.01)

(52) U.S. Cl. ..... 345/619; 345/589

(58) Field of Classification Search ..... 345/619, 345/87, 592, 58; 382/169–170
See application file for complete search history.

(56) References Cited

U.S. PATENT DOCUMENTS

| | | | | |
|---|---|---|---|---|
| 5,042,077 | A * | 8/1991 | Burke | 382/169 |
| 7,006,091 | B2 * | 2/2006 | Masera et al. | 345/619 |
| 7,538,308 | B2 | 5/2009 | Oyama | |
| 7,762,671 | B2 | 7/2010 | Saito | |
| 2006/0171573 | A1 * | 8/2006 | Rogers | 382/128 |
| 2007/0046596 | A1 * | 3/2007 | Sakakibara et al. | 345/87 |
| 2007/0176944 | A1 * | 8/2007 | Brown et al. | 345/592 |
| 2007/0183656 | A1 | 8/2007 | Kuwahara | |
| 2009/0231480 | A1 | 9/2009 | Oyama | |
| 2009/0324075 | A1 * | 12/2009 | Shiiyama | 382/170 |

FOREIGN PATENT DOCUMENTS

| | | | |
|---|---|---|---|
| JP | 64-074678 | A | 3/1989 |
| JP | 06-186946 | A | 7/1994 |
| JP | 08-087261 | | 4/1996 |
| JP | 10-274976 | | 10/1998 |
| JP | 2001-042851 | | 2/2001 |
| JP | 2005-190009 | | 7/2005 |
| JP | 2006-121181 | A | 5/2006 |
| JP | 2006-211103 | A | 8/2006 |
| WO | WO-2005-081187 | A | 9/2005 |

* cited by examiner

*Primary Examiner* — Chante Harrison
(74) *Attorney, Agent, or Firm* — AdvantEdge Law Group, LLC

(57) ABSTRACT

An image display device for displaying an image includes an image display unit that displays an image based on image data inputted from the outside, a superimposing unit that superimposes a pointer image which can be moved according to an instruction from the outside on the displayed image, a position receiving unit that receives designation of a moved position of the pointer image on the image and a highlighting unit that highlights an image in a given area which is determined based on a property of a pixel corresponding to the received moved position.

8 Claims, 4 Drawing Sheets

IMAGE DISPLAY DEVICE, HIGHLIGHTING METHOD

BACKGROUND

1. Technical Field

The present invention relates to an image display device, and particularly relates to a highlighting technique of an image displayed by the image display device.

2. Related Art

In recent years, a projector which projects images on a screen and the like based on image data outputted from a personal computer and the like is becoming popular. The projector is used when, for example, a desired graph image is projected on a large-sized screen to explain the graph image at a conference or a presentation. In the case that the projector is used for the application, when there are many component elements included in the graph, there is a case in which it is difficult for viewers of the projected image to discriminate which component element of the graph explained by an expositor corresponds to which component element of the projected image. Also, in the case that colors of plural component elements included in the graph are similar to one another, there is a case in which it is difficult to make discrimination of component elements for viewers of the projection image. Particularly, when color standards are not matched on the providing side of image data and on the side of the projector such that a graph image created on a display deviated from a color standard of sRGB and the like is projected, or a case in which projection is performed by using a projector having a color standard deviated from the above color standard, the image is sometimes projected in colors not intended by a creator of the graph, therefore, the above-described problem tends to occur. Such problem is not limited to the projector but is common to various image display devices which display images by receiving image data from the outside.

JP-A-2005-190009, JP-A-10-274976 and JP-A-8-87261 are examples of related art.

SUMMARY

An advantage of some aspects of the invention is to improve discrimination property of image component elements of an image displayed by an image display device.

The invention can be realized as the following embodiments or application examples.

APPLICATION EXAMPLE 1

An image display device for displaying an image includes an image display unit that displays an image based on image data inputted therein, a superimposing unit that superimposes a pointer image on the displayed image, a position receiving unit that receives designation of a position of the pointer image on the image and a highlighting unit that highlights an image in a given area which is determined by a property of a pixel corresponding to the designated position.

The image display device having the above configuration receives a moved position of a pointer image superimposed on the display image and highlighting an image in a given area determined by a property of a pixel corresponding to the designated position of the pointer image. Therefore, the user can improve discrimination property of the image in the given area easily by instructing to move a position of the pointer image. Also, at the time of presentation by using the image display device and some other occasions, an expositor can give an explanation while highlighting the given area of the image displayed by the image display device, therefore, explanation of the point is given efficiently so as to be easily understandable. Furthermore, the user instructs to move a position of the pointer image while checking the image displayed by the image display device, therefore, even when color standards are not matched on the side of providing image data to the image display device and on the side of the image display device receiving the image data, it is possible to positively specify an image component element which is difficult to be discriminated and to instruct the specified element by the moved position of the pointer image.

APPLICATION EXAMPLE 2

In the image display device according to Application Example 1, the highlighting unit highlights a group of pixels having corresponding gray-scale values corresponding to a gray-scale value of a designated pixel which corresponds to the designated position as an image within the given area.

The image display device having the above configuration highlights the pixel group having corresponding gray-scale values corresponding to the gray-scale value of the pixel which corresponds to the position of the pointer image designated by user as the image within the given area. Therefore, the user can highlight the desired image by simple operation of just designating a position of a color which is desired to be highlighted on the display image. The corresponding gray-scale values are gray-scale values including a predetermined range fixed based on the gray scale value of the designated pixel and the same gray-scale value as the gray scale value of the designated pixel.

APPLICATION EXAMPLE 3

In the image display device according to Application Example 1, the highlighting unit highlights a group of pixels having corresponding gray-scale values corresponding to a gray-scale value of a designated pixel which corresponds to the designated position and disposed continuously as an image within the given area.

The image display device having the above configuration highlights the group of pixels having corresponding gray-scale values corresponding to the gray-scale value of the pixel which corresponds to the position of the pointer image designated by user and disposed continuously as the image in the given area. Therefore, the user can highlight only a desired image component element even when there are plural image component elements within the corresponding gray-scale values.

APPLICATION EXAMPLE 4

In the image display device according to Application Example 2 or 3, the corresponding gray-scale values are gray-scale values having a predetermined range determined based on the gray-scale value of the designated pixel.

The image display device having the above configuration highlights a group of pixels having gray-scale values in the predetermined range determined based on the gray-scale value of the designated pixel as the image in the given area. Therefore, even when a signal indicating the gray-scale value of the image is affected by noise, the given area can be accurately fixed. Even when a portion desired to be highlighted is expressed in plural similar colors, the given area can be accurately fixed.

APPLICATION EXAMPLE 5

In the image display device according to any one of Application Examples 1 to 4, the highlighting unit is a unit that blink-displays the image corresponding to the given area.

In the image display device having the above configuration, it is possible to allow the image in the given area to be easily discriminated when the highlighting unit is used as a blink-display unit. As other highlighting units, various highlighting units such as white display, black display and inverted-color display can be used.

APPLICATION EXAMPLE 6

In the image display device according to Application Example 5, the highlighting unit performs the blink-display by alternately displaying an image based on a gray-scale value obtained by converting gray-scale values of respective pixels included in the image in the given area by using a lookup table and an image based on gray scale values before the conversion is performed.

The image display device having the above configuration performs blink display by alternately displaying the image based on the gray-scale value converted by using the lookup table and the image based on gray scale values before the conversion, therefore, blink-display can be performed by the simple configuration.

APPLICATION EXAMPLE 7

In the image display device according to any one of Application Examples 1 to 6, the image display device is a projector and the image display unit is a unit that projects an image on a prescribed projection surface.

The image display device having the above configuration can be realized as a projector. The device can be also realized as a monitor, a TV and the like.

The invention can be realized also as a highlighting method of Application Example 8.

APPLICATION EXAMPLE 8

A highlighting method which highlights a given area in the image displayed by an image display device displaying the image based on image data inputted therein, displaying a pointer image on the displayed image, receiving designation of a position of the pointer image and highlighting an image in a given area which is determined by a property of a pixel corresponding to the designated position of the pointer image on the image.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention will be explained.

A. SCHEMATIC CONFIGURATION OF PROJECTOR

A projector PR as an embodiment of an image display device according to an embodiment of the invention will be explained with reference to FIG. 1. The projector PR is connected to a computer PC by a USB cable, which is capable of projecting an image on a screen SC by receiving image data from the computer PC. A connection method between the computer PC and the projector PR is not particularly limited, and they may be connected, for example, through a wired or wireless network. As a matter of course, a method of inputting image data to the projector PR is not particularly limited, and for example, image data can be inputted from a storage medium and the like connected to the projector PR, instead of the input from the computer PC.

Figure 1:
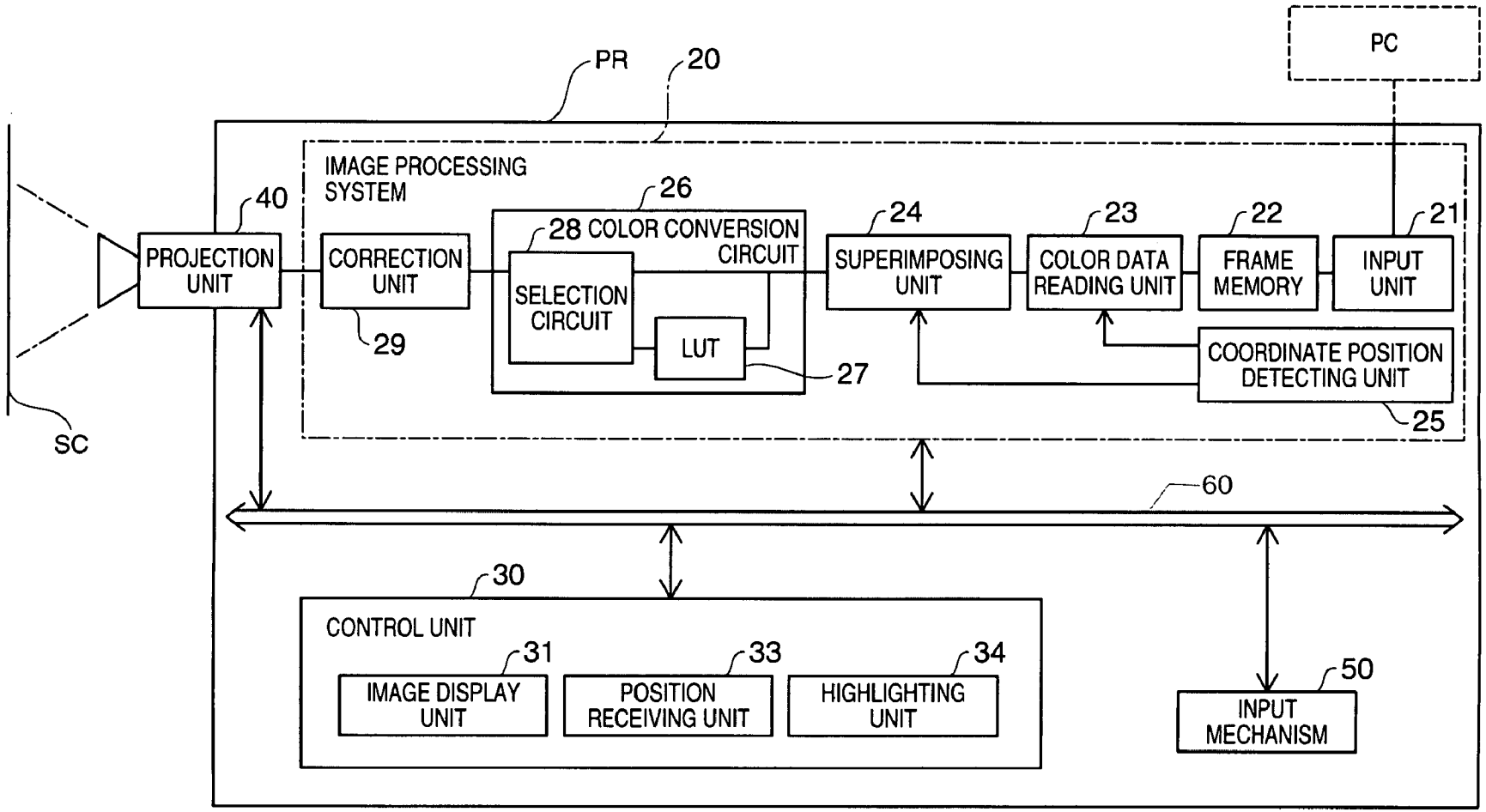
FIG. 1 is an explanatory diagram showing a schematic configuration of a projector PR as an embodiment.

The projector PR includes an image processing system 20, a control unit 30, a projection unit 40 and an input mechanism 50, which are connected to one another by a bus 60 as shown in FIG. 1. The image processing system 20 includes an input unit 21, a frame memory 22, a color data reading unit 23, a superimposing unit 24, a coordinate position detecting unit 25, a color conversion circuit 26 and a correction unit 29.

An image data signal (an RGB type in this case) inputted from the computer PC into the image processing system 20 is received by the input unit 21 and written in the frame memory 22. Then, the image signal read from the frame memory 22 is inputted to the color data reading unit 23. The color data reading unit 23 reads color data of specific coordinate position from the inputted image signal, then, outputs the image signal to the superimposing unit 24. The superimposing unit 24 is a circuit module which superimposes a pointer image which can be moved and displayed by the later-described input mechanism 50 on an image displayed by the inputted image signal. The coordinate position detecting unit 25 is a circuit detecting a coordinate position of the image in the image signal, instructing the superimposing unit 24 to superimpose the pointer image at a prescribed timing. The coordinated position detecting unit 25 also instructs the color data reading unit 23 to read color data. The details of these functions will be described later in "B. Highlighting Processing".

The color conversion circuit 26 includes a lookup table (LUT) circuit 27 and a selection circuit 28. The LUT circuit 27 has a not-shown memory storing a LUT in which input gray-scale values are associated with output gray-scale values with respect to respective colors of RGB, converting a gray-scale value indicated by the input signal from the superimposing unit 24 into a prescribed value based on the LUT and outputting the signal. The selection circuit 28 is a selection circuit which can switch the image signal to be outputted between a signal passed through the LUT circuit 27 and a signal not being passed through the LUT circuit 27 by using an analog switch. The details of the function of the color conversion circuit 26 will be described in "B. Highlighting Processing". The output signal from the color conversion circuit 26 is inputted to the correction unit 29, where correction processing such as gamma correction is performed.

The image signal outputted from the image processing system 20 is inputted to the projection unit 40. The projection unit 40 includes a liquid-crystal panel drive unit, a liquid crystal panel, a light-source lamp unit, a projection optical system and the like. The liquid-crystal panel drive unit drives the liquid crystal panel based on the inputted image signal. Light irradiated from the light-source lamp unit is modulated by the liquid crystal panel for respective colors of RGB and passes through the projection optical system, then, an image formed by the liquid crystal panel is displayed on the screen SC. In the present embodiment, the liquid crystal type is used in the projection unit 40, but it is not limited to this type and various types can be used, such as a CRT type, a DLP(registered trademark) type, LCoS (registered trademark) type and GLV(registered trademark) type.

The input mechanism 50 includes cross-shaped cursor keys and a determination button. The user can input various setups and can operate a pointer as a pointing device by operating these keys. The input mechanism 50 includes plural keys in the embodiment, however, it is not limited to this, and may include other devices such as a mouse, a remote controller and a touch panel.

The control unit 30 is formed by a computer including a CPU, a ROM, a RAM, a register and the like, controls the whole function of the projector PR based on programs stored in the ROM and functions as an image display unit 31, a position receiving unit 33 and a highlighting unit 34. The details of these functional units will be described later in "B. Highlighting Processing".

B. HIGHLIGHTING PROCESSING

Figure 2:
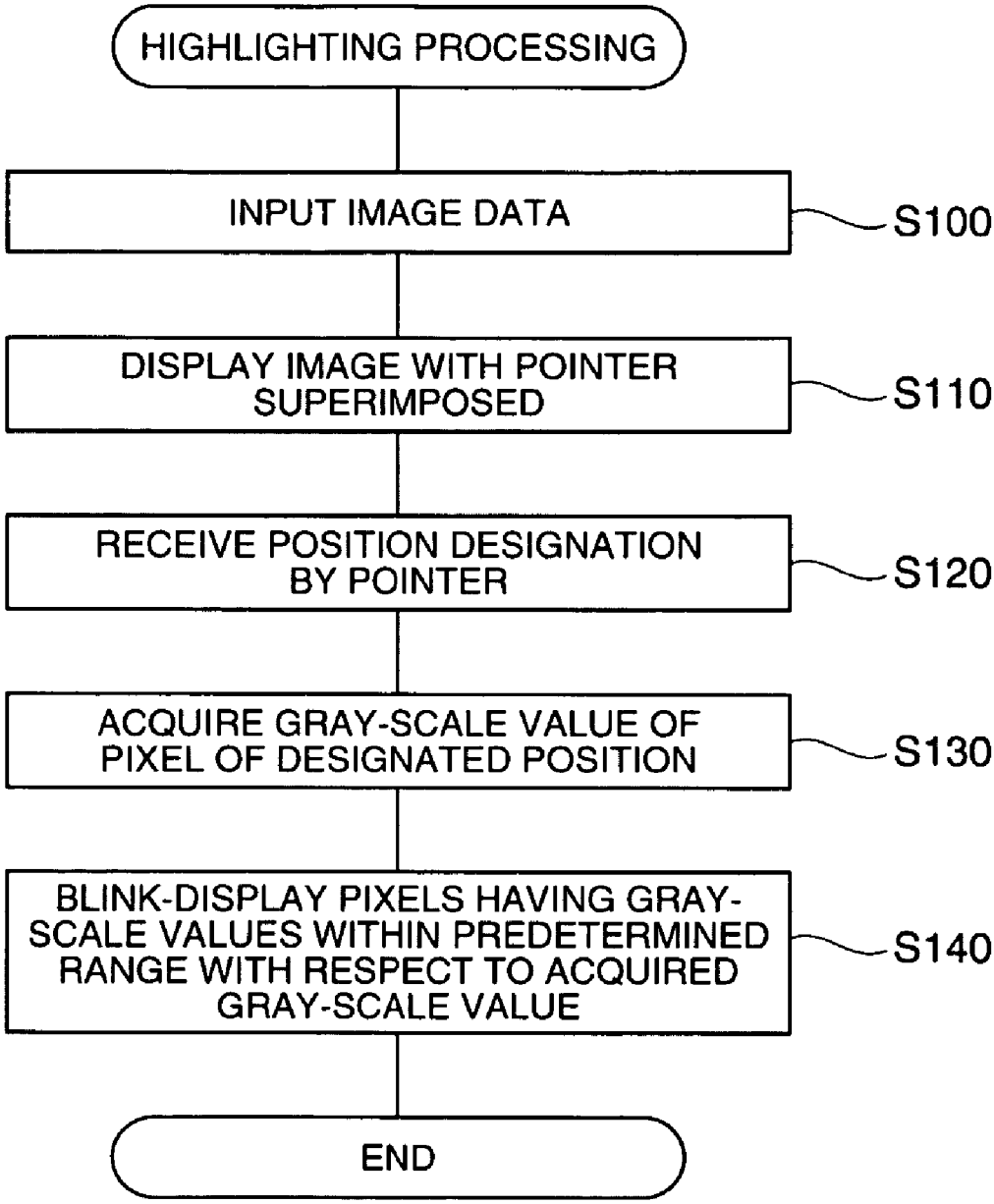
FIG. 2 is a flowchart showing the flow of highlighting processing.

Highlighting processing using the projector PR will be explained with reference to FIG. 2. The highlighting processing is processing of highlighting image component elements which are difficult to be discriminated on a projection screen or image component elements to be explained to thereby display the component elements to be discriminated easily when an image is projected on the screen SC by using the projector PR. The processing is started by the input unit 21 of the projector PR receiving image data from the computer PC and inputting the data (Step S100). The inputted image data is written in the frame memory 22.

The image data written in the frame memory 22 is read out based on a synchronization signal generated by the control unit 30 and inputted to the superimposing unit 24 through the color data reading unit 23. In the superimposing unit 24, a pointer image is superimposed on the image shown by the image data inputted from the frame memory 22. Then, the control unit 30 controls the projection unit 40 as processing of the image display unit 31 based on the superimposed image data outputted from the superimposing unit 24 and inputted to the projection unit 40 through the color conversion circuit 26 and the correction unit 29, thereby projecting the superimposed image on the screen SC (Step S110). In this stage, the selection circuit 28 of the color conversion circuit 26 connects the superimposing unit 24 to the correction unit 29 in a route not passing through the LUT circuit.

Figure 3A:
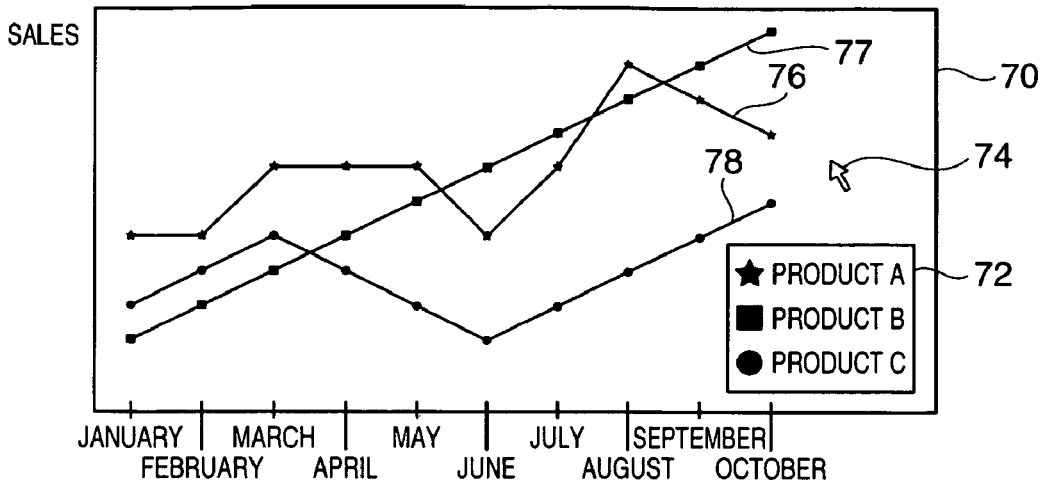
FIG. 3A to FIG. 3C are explanatory graphs showing the contents of highlighting processing specifically.

In the above Step S110, specifically, for example, when a graph image 70 showing transition of sales of products A to C is projected as shown in FIG. 3A, a pointer image 74 is superimposed on the image of the graph image 70 to be displayed. Graph component elements 76 to 78 included in the graph image 70 show the transition of sales of products A to C shown in an explanatory note 72, each has a color of the same gray-scale value as a corresponding marker in the explanatory note 72. In the embodiment, the pointer image 74 is displayed at a prescribed coordinate position on the image which is set by default. The coordinate position detecting unit 25 counts pulses of the synchronization signal generated by the control unit 30, instructing the superimposing unit 24 to display the pointer image 74 when image data corresponding to the above default position is inputted to the superimposing unit 24. Receiving the instruction, the superimposing unit 24 displays the pointer image 74 by converting the inputted image data into image data of the pointer image 74 and outputting the image data.

The pointer image 74 can be moved to a desired position on the image of the projected graph image 70 by user operation. Specifically, when the user inputs a displacement amount of the pointer image 74 by using the cross-shaped cursor keys of the input mechanism 50, the control unit 30 reads the displacement amount from the input mechanism 50 and indicates a displacement coordinate value corresponding to the displacement amount to the coordinate position detecting unit 25. The coordinate position detecting unit 25 instructs the superimposing unit 24 to display the pointer image 74 when image data corresponding to the designated coordinate position is inputted to the superimposing unit 24. Receiving the instruction, the superimposing unit 24 replaces the inputted image data to image data of the pointer image 74 and outputs the image data. The pointer image 74 is moved by projecting the superimposed image data by the projection unit 40 in the same manner as the original superimposed data.

In the embodiment, a configuration in which the pointer image 74 is always superimposed by the superimposing unit 24 when the graph image 70 is displayed is applied, however, it is also preferable that the superimposed display of the pointer image 74 is limited to a case when the user desires the display. For example, the pointer image 74 may be superimposed on the image of the graph image 70 only when the user selects a "highlighting mode" by using the input mechanism 50.

Figure 3B:
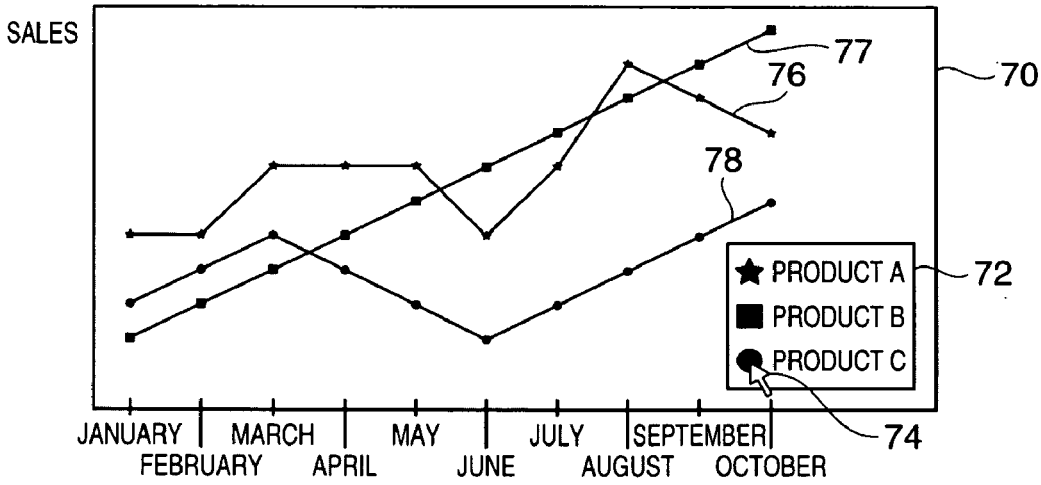

After the image is displayed with the pointer image superimposed, the control unit 30 receives designation of a moved position by the pointer image as processing of the position receiving unit 33 (Step S120). The designation of the position is performed for designating a given area of the image at which highlighting is performed in later-described Step S140 by the user moving the pointer image 74 using the above method. Specifically, for example, the user moves the pointer image 74 to a portion of a marker "●" indicating "Product C" in the explanatory note 72 by using the cross-shaped cursor keys of the input mechanism 50 as shown in FIG. 3B, and presses the determination button of the input mechanism 50, thereby, the control unit 30 receives designation of the position.

When receiving designation of the position, the control unit 30 acquires a gray-scale value of a pixel of the designated position (Step S130). Specifically, for example, the control unit 30 acquires a coordinate value of the designated position from the input mechanism 50 and outputs the value to the coordinate position detecting unit 25. The coordinate position detecting unit 25 counts pulses of the synchronization signal generated by the control unit 30 instructing the color data reading unit 23 to read color data when image data corresponding to the coordinate value of the designated position is inputted to the color data reading unit 23. Receiving the instruction, the color data reading unit 23 outputs the inputted image data also to the control unit 30. Accordingly, the control unit 30 acquires respective gray-scale values of RGB corresponding to the coordinate value of the designated position. It is not limited to a configuration in which the gray-scale value is acquired from the color data reading unit 23 but the gray-scale value may be acquired from other units in the image processing system 20. For example, a configuration in which the gray-scale value is acquired from the frame memory 22 can be applied.

After acquiring the gray-scale value, the control unit 30 allows pixels having gray-scale values within a predetermined range with respect to the acquired gray-scale value to blink-display as processing of the highlighting unit 34 (Step S140). Specifically, the blink display is performed in the following manner.

When acquiring the gray-scale value, the control unit 30 creates a LUT for converting a signal indicating gray-scale values within a predetermined range with respect to the acquired gray-scale value into a prescribed value. For example, the control unit 30, when acquiring gray-scale values (R, G, B)=(150, 50, 30), creates a LUT for converting gray-scale values within predetermined ranges (R, G, B)=(145 to 155, 45 to 55, 25 to 35) with respect to the acquired gray-scale values into a prescribed value. The widths of the predetermined ranges are previously set.

Figure 4:
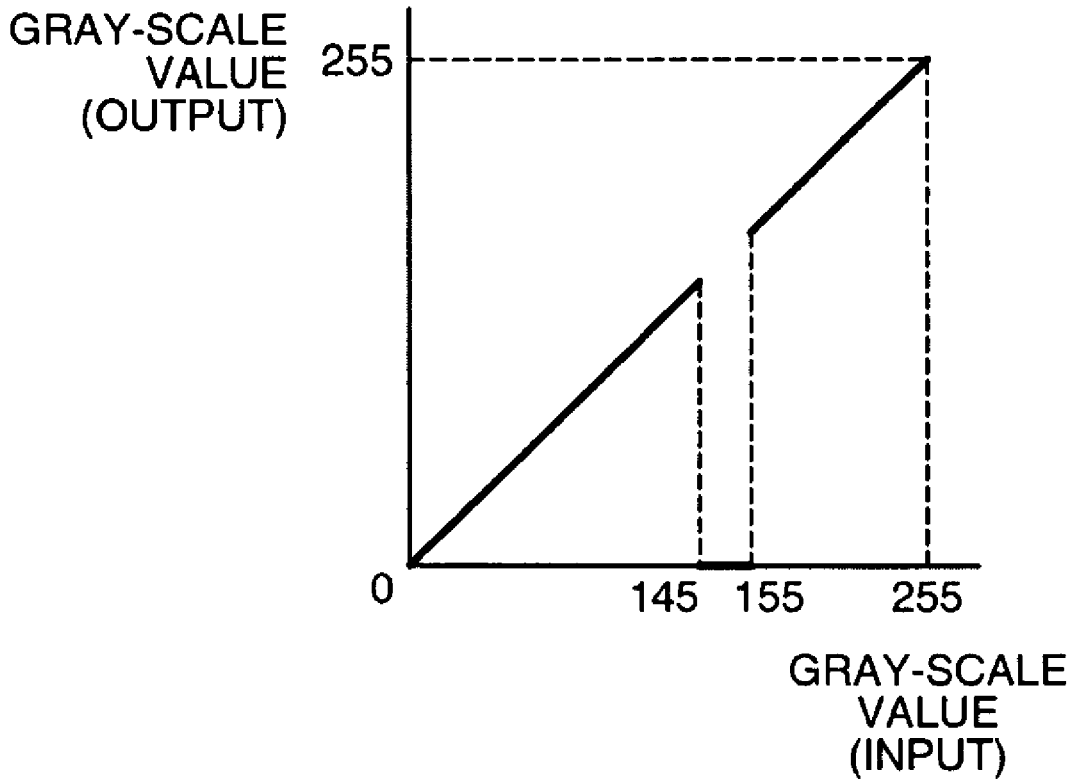
FIG. 4 is an explanatory graph showing gray-scale value conversion characteristic of an LUT.

The conversion characteristic of the LUT according to the embodiment is shown in FIG. 4. FIG. 4 shows conversion characteristic of an R gray-scale value in RGB. When a gray-scale value indicated by the input signal (hereinafter, referred to as an input gray-scale value) corresponds to a predetermined range (in this case, R=145 to 155) with respect to the acquired gray-scale value, the input signal is outputted after converted into a signal indicating a fixed gray-scale value "0" which is previously prescribed. When the input gray-scale value does not correspond to the range of the gray-scale value, a signal indicating the same gray-scale value as the input gray-scale value is outputted without performing conversion. Concerning a G-gray scale value and a B-gray scale value, the same processing is performed, though not shown.

After creating the LUT, the control unit 30 writes the LUT in the LUT circuit 27. On the other hand, the LUT circuit 27, when the signal of the gray-scale value is inputted into the LUT circuit 27 from the superimposing unit 24, converts the input gray-scale value into a prescribed value and outputs the signal by referring to the written LUT. The conversion characteristic in this case is as described above. The conversion processing is performed one by one concerning gray-scale values of respective colors of RGB.

Figure 3C:
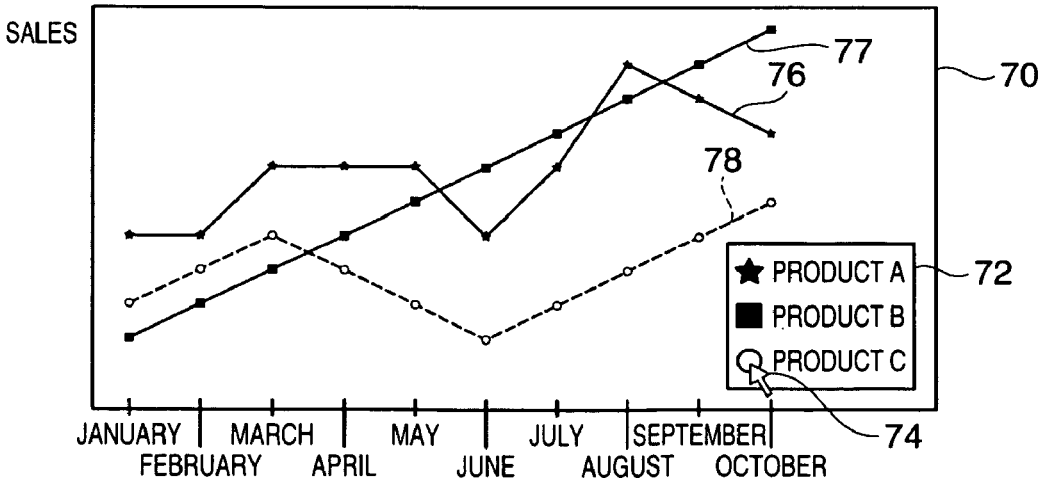

The control unit 30 outputs a signal for switching a route passing through the LUT circuit 27 and a route not passing through the LUT circuit 27 to the selection circuit 28 every fixed time. The above processing is performed to thereby allowing the graph component element 78 including pixels having the same gray-scale value as the portion of the marker "●" indicating the "Product C" in the explanatory note 72 to blink-display by the simple configuration as shown in FIG. 3C. Accordingly, the highlighting processing has completed. The configuration for the blink display described above is an example, and various well-known techniques for blink display can be used.

In the case that, for example, a graph component element 77 is desired to be blink-displayed continuously while the graph component element 78 is blink displayed, the user designates a position having the same color as the graph component element 77 by using the input mechanism 50, thereby, the control unit 30 performs blink-display of the graph component element 77 by repeating the above processing. Also, in the case that the blink display is desired to be stopped, the user performs an instruction corresponding to the stop, for example, pressing a cancel button included in the input mechanism 50 to stop the blink display.

The projector PR having the above configuration displays the pointer image 74 which can be moved by the input mechanism 50 by superimposing the image on the graph image 70, receiving designation of an arbitrary position on the image by using the pointer image 74. Then, the gray-scale value of the designated pixel is acquired, and pixels having gray-scale values within the predetermined range with respect to the gray-scale value are blink-displayed. Therefore, even in the case that display colors of component elements included in the image are similar to each other and it is difficult to discriminate them when the image is projected, a desired image component element is blink-displayed to allow the image component element to be discriminated easily. The user can also selects and designates a given area to be a target of the blink display simply by using the pointer image 74, while checking the projection screen. The user can also designate the given area by simple operation of just designating one point on the image, and can perform designation operation of the given area simply even when the desired given area is a linear figure or a figure having complicated outline. Additionally, at a presentation and the like using the image display device, the expositor can give an explanation while highlighting the given area of the image displayed by the image display device, therefore, explanation of the point is given efficiently so as to be easily understandable.

Moreover, the projector PR having the above configuration acquires the gray-scale value of the designated pixel and blink-displays pixels having gray-scale values within the predetermined range with respect to the gray-scale value. Therefore, even when a signal indicating the gray-scale value is in an environment affected by noise, the image component element having the same gray-scale value as the designated pixel can be blink-displayed. Also, when the given area to be blink-displayed has plural gray-scale values within a prescribed range, for example, even when the given area to be blink-displayed is a graph component element with hatching or gradation of the similar color, the user can designate the whole desired graph component element as a given area to be blink-displayed by simple operation of just designating one point.

The function of designating a given area to blink-display the area can be implemented on the side of the computer PC, that is, can be realized by a configuration in which image data corresponding to blink display is prepared on the side of the computer PC and the image data is transmitted to the projector PR to be projected. However, when the user designates a given area on the display of the computer PC and transmits data whose gray-scale values are converted by the computer PC to the projector PR to be projected, in the case that color standards taken by the computer PC and on the projector PR are not matched, colors of the projected image are largely different from colors on the display of the computer PC, therefore, it may become necessary that another given area which is difficult to be discriminated on the projected image is designated again to be blink-displayed. On the other hand, if the function is secured on the side of the projector PR as shown in the embodiment, since the user designates a given area on the projected image, such problem does not occur.

If the function is secured on side of the projector PR, even in the case that the projector PR is connected to a computer PC not including the blink-display function, or even in the case that the computer PC is not connected to the projector PR, a storage medium such as a USB memory is connected thereto and the projector PR receives image data from the storage medium to perform display, a desired blink display can be performed, which will be excellent in general versatility.

C. MODIFICATION EXAMPLES

Modification examples with respect to the above embodiment will be explained.

C-1. Modification Example 1

In the embodiment, the configuration in which the gray-scale value of the designated pixel is acquired and pixels having gray-scale values in the predetermined range with respect to the gray-scale value are blink-displayed is applied, however, it is also preferable to apply a configuration in which only the same gray-scale value as the designated gray-scale value is blink-displayed. According to this, the configuration can be simpler.

C-2. Modification Example 2

In the embodiment, the configuration in which the control unit 30 creates the LUT and writes the LUT in the LUT circuit 27 is applied, however, it is not limited to the configuration. For example, it is also preferable to apply a configuration in which the control unit 30 outputs the gray-scale value acquired from the color data reading unit 23 and the signal indicating gray-scale values within the predetermined range to the LUT circuit 27, and the LUT circuit 27 creates the LUT.

C-3. Modification Example 3

In the embodiment, the configuration in which gray-scale values of respective colors of RGB representing the image are converted by using the LUT circuit 27 is applied, however, it is also preferable to apply a configuration in which only the gray-scale value of a predetermined color element, for example, the "R" gray-scale value is converted. According to this, it is possible to highlight the given area by a simpler configuration. The gray-scale values used in the projector PR are not limited to the RGB type, and various types such as a YCC type can be used. Also in such cases, it is preferable that conversion is performed with respect to gray-scale values of all color elements or luminance values or it is also preferable that conversion is performed with respect to gray-scale values of part of color elements or luminance values.

C-4. Modification Example 4

In the embodiment, the configuration is applied, in which the signal indicating gray-scale values within the predetermined range in signals indicating the input gray-scale values is uniformly converted into the signal indicating a fixed gray-scale value which is previously set ("0" in the embodiment) in the LUT circuit 27, however, the gray-scale value conversion characteristic of the LUT circuit 27 is not limited to the configuration, and it is also preferable to apply a configuration in which the conversion value is changed according to the size of the input gray-scale value.

Specifically, for example, if the input gray-scale value is less than "128", the input gray-scale value belonging to a predetermined range received from the control unit 30 may be converted into a gray-scale value "255", and if the input gray-scale value is "128" or over, the input gray-value may be converted into a gray-scale value "0", or the input gray-scale value may be converted into a gray-scale value indicating a color opposite to the color indicated by the input gray-scale value. According to this, two kinds of colors displayed before and after the blink can be colors which are clearly discriminated from each other, therefore, discrimination property in the given area at the time of blink display is improved.

C-5. Modification Example 5

In the embodiment, the configuration in which the gray-scale value of the designated pixel is acquired and pixels having gray-scale values in the predetermined range with respect to the gray-scale value are blink-displayed is applied, however, it is also preferable to apply a configuration in which a group of pixels having gray-scale values in the predetermined range with respect to the gray-scale value and continuously disposed is blink-displayed. Specifically, for example, it is also preferable to apply a configuration in which only the portion of "●" is blink-displayed (the graph component element 78 is not blink-displayed) when the user designates a position at a portion of the marker "●" indicating the "Product C" in the explanatory note 72 by using the pointer image 74 as shown in FIG. 3B. According to this, even when there are plural image component elements formed by pixels having gray-scale values within the predetermined range with respect to the gray-scale value of the designated pixel, or even when gray-scale values within the predetermined range are used at part of a background, the user can highlight only the image component element by designating one point on the desired image component element.

In order to apply the above configuration, for example, the control unit 30 specifies a group of pixels having gray-scale values in the predetermined range with respect to the gray-scale value corresponding to the coordinate value at the designated position and continuously disposed by referring to the frame memory 22. Then, at the time of output from the superimposing unit 24 to the color conversion circuit 26, whether an output signal corresponds to the signal of the specified group of pixels is determined by counting pulses of the synchronization signal, and when the signal corresponds, output is performed by a route passing through the LUT circuit 27, whereas, when the signal does not correspond, output is performed by a router not passing through the LUB circuit 27.

C-6. Modification Example 6

In the embodiment, the pointer image 74 is moved by using the cross-shaped cursor keys included in the input mechanism 50 to designate the image position for specifying the gray-scale value to be highlighted, however, the pointing device for moving the pointer image 74 is not limited to the cross-shaped cursor keys, and various devices such as a remote controller and a mouse can be used.

C-7. Modification Example 7

In the embodiment, the configuration in which the group of pixels having gray-scale values within the predetermined range with respect to the gray-scale value of the pixel designated by the user is blink-displayed is applied, however, it is also preferable to apply a configuration in which pixels other than the group of pixels are blink-displayed. According to this, in the case that the designated predetermined range occupies most of the projected display image, processing can be simplified.

C-8. Modification Example 8

In the embodiment, the specific component element included in the image (in the example of FIGS. 3A to 3C, the graph component element 78) is blink-displayed to realize display in which the component element can be discriminated easily, however, the method of highlighting is not limited to the blink display. For example, various methods of highlighting can be used such that a specific component element is displayed in white, displayed in black or displayed in an inverted color by performing only the conversion of the gray-scale value using the LUT.

C-9. Modification Example 9

In the embodiment, whether the conversion of the gray-scale value is possible or not is determined based on the gray-scale value indicated by the image signal, however, it is not limited to the configuration, and it is also preferable to determine whether the conversion of the gray-scale value is possible or not based on a coordinate value. For example, it is also preferable to apply a configuration in which the control unit 30 acquires the gray-scale value of the designated position in the Step S130, then, creates a table in which coordinates of pixels having gray-scale values within the predetermined range with respect to the gray-scale value are recorded based on data of the frame memory 22, and the output destination of the image signal from the superimposing unit 24 is switched between the uniform conversion circuit and the non-conversion circuit of the image signal based on the table.

C-10. Modification Example 10

In the embodiment, the group of pixels having gray-scale values within the predetermined range with respect to the gray-scale value of the pixel whose position is designated by the user is a given area to be blink-displayed, however, a method of determining the given area is not limited to the configuration, and the area can be determined based on properties of the designated pixel. For example, the control unit 30 performs edge detection based on luminance values with respect to an image of one frame, and may determine an area in the closed edge including the pixel whose position is designated by the user as a given area to be blink-displayed.

C-11. Modification Example 11

It is preferable that part of configuration realized by hardware in the embodiment is replaced with software, and it is also possible that part of configuration realized by software is replaced with hardware.

Although the embodiment of the invention has been explained as the above, the invention is not limited to the above embodiment, and it goes without saying that the invention can be achieved in various manners within a scope not departing from the gist of the invention. For example, the invention can be realized in forms of various image display devices, not limited to a projector shown in the embodiment, which display an image based on image data inputted from the outside such as a flat-panel monitor or a TV, and the highlighting method and the like which highlight a given area of an image displayed by the image display device.

The entire disclosure of Japanese Patent Application No. 2008-036450, filed Feb. 18, 2008 is expressly incorporated by reference herein.

What is claimed is:

1. An image display device for displaying an image, comprising:

an image display unit that displays a graph image based on image data inputted therein, the displayed graph image including:

a plurality of graph component elements, each of the plurality of graph component elements including pixels having a gray-scale value that is different than gray-scale values of pixels in other graph component elements of the plurality of graph component elements, and an explanatory region, the explanatory region including a plurality of markers, each of the plurality of markers corresponding to and identifying a separate graph component element of the plurality of graph component elements, each of the plurality of markers having a gray-scale value corresponding to a gray-scale value of the corresponding graph component element;

a superimposing unit that superimposes a pointer image on the displayed image, the pointer image being movable over the displayed image;

a position receiving unit that receives designation of a position of the pointer image on the displayed image; and a highlighting unit that highlights a first graph component element of the plurality of graph component elements corresponding to a first marker of the plurality of markers, the first marker being located at the designated position of the pointer image.

2. The image display device according to claim 1, wherein the highlighting unit highlights a group of pixels having corresponding gray-scale values corresponding to a gray-scale value of a designated pixel which corresponds to the designated position as the first graph component element.

3. The image display device according to claim 2, wherein the corresponding gray-scale values are gray-scale values within a predetermined range with respect to the gray-scale value of the designated pixel.

4. The image display device according to claim 1, wherein the highlighting unit highlights a group of pixels having corresponding gray-scale values corresponding to a gray-scale value of a designated pixel which corresponds to the designated position and disposed continuously as the first graph component element.

5. The image display device according to claim 1, wherein the highlighting unit is a unit that blink-displays the first graph component element.

6. The image display device according to claim 5, wherein the highlighting unit performs the blink-display by alternately displaying an image based on a gray-scale value obtained by converting gray-scale values of respective pixels included in the image in the given area by using a lookup table and an image based on gray scale values before the conversion is performed.

7. The image display device according to claim 1, wherein the image display device is a projector, and the image display unit is a unit that projects an image on a prescribed projection surface.

8. A highlighting method which highlights a given area in a graph image displayed by an image display device displaying the graph image based on image data inputted therein, the displayed graph image including a plurality of graph component elements, each of the plurality of graph component elements including pixels having a gray-scale value that is different than gray-scale values of pixels in other graph component elements of the plurality of graph component elements, and an explanatory region, the explanatory region including a plurality of markers, each of the plurality of markers corresponding to and identifying a separate graph component element of the plurality of graph component elements, each of the plurality of markers having a gray-scale value corresponding to a gray-scale value of the corresponding graph component element, the highlighting method comprising:

superimposing a pointer image on the displayed image, the pointer image being movable over the displayed image;

receiving designation of a position of the pointer image on the displayed image; and highlighting a first graph component element of the plurality of graph component elements corresponding to a first marker of the plurality of markers, the first marker being located at the designated position of the pointer image on the displayed image.

* * * * *